US007748228B2

(12) United States Patent
Walker et al.

(10) Patent No.: US 7,748,228 B2
(45) Date of Patent: Jul. 6, 2010

(54) REFRIGERATION SYSTEM CAPABLE OF MULTI-FACETED OPERATION

(75) Inventors: Darrel Jay Walker, Mt. Pleasant, MI (US); William E. Smith, Land O'Lakes, FL (US); Harry Edward Wing, Midland, MI (US)

(73) Assignee: The Delfield Company, LLC, Mt. Pleasant, MI (US)

( * ) Notice: Subject to any disclaimer, the term of this patent is extended or adjusted under 35 U.S.C. 154(b) by 0 days.

(21) Appl. No.: 11/653,040

(22) Filed: Jan. 12, 2007

(65) Prior Publication Data

US 2007/0180849 A1 Aug. 9, 2007

Related U.S. Application Data

(60) Provisional application No. 60/758,871, filed on Jan. 13, 2006.

(51) Int. Cl.
*F25D 23/12* (2006.01)

(52) U.S. Cl. ..... 62/258; 62/198; 62/382

(58) Field of Classification Search ..... 62/258, 62/382, 125–127, 404–426, 198–200, 246–256, 62/440–441

See application file for complete search history.

(56) References Cited

U.S. PATENT DOCUMENTS

| | | | | |
|---|---|---|---|---|
| 2,455,182 | A * | 11/1948 | La Vallee | 62/131 |
| 4,193,271 | A * | 3/1980 | Honigsbaum | 62/180 |
| 4,802,340 | A * | 2/1989 | Johnson | 62/229 |
| 5,277,039 | A * | 1/1994 | Haasis | 62/448 |
| 6,038,865 | A * | 3/2000 | Watanabe et al. | 62/3.6 |
| 6,564,569 | B1 * | 5/2003 | Havens | 62/258 |
| 6,901,767 | B2 | 6/2005 | Wood | 62/371 |
| 6,915,657 | B1 | 7/2005 | Wood | 62/371 |
| 7,069,732 | B2 * | 7/2006 | Walker et al. | 62/99 |
| 7,197,888 | B2 * | 4/2007 | LeClear et al. | 62/186 |
| 7,219,508 | B2 * | 5/2007 | Durbin | 62/257 |
| 7,269,964 | B2 * | 9/2007 | Hand | 62/258 |

FOREIGN PATENT DOCUMENTS

| | | |
|---|---|---|
| NZ | 260493 | 9/1996 |
| WO | WO 2005/024314 | 3/2005 |
| WO | WO 2005/024315 | 3/2005 |

OTHER PUBLICATIONS

Examination Report dated Dec. 10, 2009 from corresponding New Zealand Patent Application No. 566766.

* cited by examiner

*Primary Examiner*—William E Tapolcai
(74) *Attorney, Agent, or Firm*—Ohlandt, Greeley, Ruggiero & Perle, L.L.P.

(57) ABSTRACT

A storage system that has variable temperature includes one or more drawers. The one or more drawers are independently operable of one another. A heating and cooling system is in thermal communication with the one or more drawers. The heating and cooling system generates even air-flow around all sides of the one or more drawers for heating and/or cooling thereof.

20 Claims, 3 Drawing Sheets

REFRIGERATION SYSTEM CAPABLE OF MULTI-FACETED OPERATION

CROSS REFERENCE TO RELATED APPLICATIONS

This application claims priority to U.S. Provisional Application Ser. No. 60/758,871, filed Jan. 13, 2006, the disclosure of which is incorporated herein by reference.

BACKGROUND OF THE INVENTION

1. Field of the Invention

This invention relates generally to refrigeration and, more particularly, a refrigeration system capable of multi-faceted operation.

2. Description of the Related Art

In the food service industry, there is a need for storing of food items in refrigerators and freezers. Food items can be blast chilled in order to reduce a temperature of the food items down to a safe storage temperature for later consumption. Food items stored in refrigerators and freezers commonly need to be thawed prior to preparation and consumption. Typically, separate appliances are required for refrigeration, freezing, thawing, and blast chilling food items undesirably requiring the food items to be transferred to multiple appliances. Different food items can require different storage temperatures; however, food items stored in the same refrigerator, freezer, thaw box, or blast chiller must all be stored at a single temperature. Refrigerators, freezers, thaw boxes, and blast chillers are typically large and undesirably occupy large areas in a kitchen or storage area.

U.S. Pat. Nos. 6,915,657 and 6,901,767 to Wood provide a refrigerator/freezer appliance having rectangular-fronted drawers arranged one above another and housed in a cabinet. The interior of the cabinet is divided by insulated lids, one for each drawer. When the drawer is closed, the open top of its associated bin is closed by an appropriate one of the lids. The lids include evaporator elements of known type disposed in the lower face of each lid. A refrigerator engine compartment includes an impeller exhausting through apertures provided in the front face of the refrigerator engine compartment. Ambient air enters the appliance where it immediately comes into contact with the outer surfaces of the bins and warms them to ambient temperature before being drawn towards a void and then upwards through the void by circulation of the air to minimize condensation. Wood undesirably requires lids for each drawer. The Wood appliance undesirably cools the product in the bin from only the top. Wood does not include the capability to be a thaw cabinet.

PCT Patent Application Publication No. WO2005024315 to Wood provides a drawer storage appliance such as a refrigerator that includes a closure being a fixed generally horizontal lid and a container being an open-topped drawer that is movable horizontally with respect to the lid. The lid has a skirt that depends therefrom to support a first sealing loop that is a continuous peripheral downwardly-facing lid seal. The skirt and the lid seal of Wood are shaped to correspond to and cooperate with a second sealing loop that is a continuous upwardly facing sealing surface around the upper peripheral rim defined by generally vertical walls of the drawer. Again, Wood undesirably requires lids, in this case, having a seal between the lid and drawer. The horizontal seal described in Wood is undesirable with its sealing plane being parallel to the drawer operation. When temperatures of the appliance interior are below freezing this may cause the seal to freeze and render the drawer inoperable because of the large shear plane forces being placed on the gasket seal.

PCT Patent Application Publication No. WO2005024314 to Wood provides a refrigerator including a refrigerant circuit having a compressor, a condenser, an expansion means and an evaporator. The evaporator includes a branched portion having a plurality of parallel branches each having a respective evaporator of the evaporator means. A four-compartment arrangement is also provided. Each compartment is cooled by a respective evaporator on respective parallel branches of the circuit. The compartments can be used as a refrigerator or as a freezer by a mass control achieved by cycling a respective solenoid shut-off valve serving each evaporator. Each branch of the circuit is served by a respective thermal expansion valve whose superheat sensor is downstream of the evaporator of that branch. Wood, as described above, is doing the same operation, which has been done for years in refrigerated appliances.

The Wood prior art described above has a drawer gasket having a disadvantage in that its sealing plane is parallel to the drawer operation. When temperatures of the appliance interior are below freezing this may cause the seal to freeze and render the drawer inoperable because of the large shear plane forces being placed on the gasket seal, as discussed above. The use of the insulated tubs described in the Wood prior art described above are not compatible with standard, readily available foodservice containers. Also, the airflow around the food product/container is only from the top.

Accordingly, there is a need for an improved refrigeration system that is capable of multi-faceted operation and allows for varied storage space. There is also a need for an improved refrigeration system that is capable of cooling a product on all sides by providing even air-flow around all sides of a containment bin. There is a further need for a seal that is perpendicular to the drawer operation. There is an additional need for a method that circulates air around the entire food product/container.

SUMMARY OF THE INVENTION

A storage system that has variable temperature is provided. The system includes one or more drawers. The one or more drawers are independently operable of one another. A heating and cooling system is in thermal communication with the one or more drawers. The heating and cooling system generates even air-flow around all sides of the one or more drawers for heating and/or cooling thereof.

A method for heating and/or cooling a storage system is also provided. The method includes generating even air-flow around all sides of a plurality of drawers by a heating and cooling system for heating and/or cooling thereof and operating of each of said plurality of drawers independently of one another.

The heating and cooling system may have at least one evaporator located at a rear compartment of the one or more drawers. The at least one evaporator may have an air duct to distribute cooled air evenly over a top opening of each of the one or more drawers. The air duct may have a thermal mass. The thermal mass may be a gel pack. The heating and cooling system may have at least one condenser, at least one compressor, and at least one evaporator. The system may further comprise at least one condenser fan. The system of may further comprise a display for user input. The one or more drawers each may have at least one mode selected from the group consisting of refrigerator mode, freezer mode, thaw cabinet mode, blast chiller mode, and any combination thereof. The one or more drawers may be free of lids.

The heating and cooling system may have at least one evaporator located at a rear compartment of the plurality of drawers. The at least one evaporator may have an air duct to distribute cooled air evenly over a top opening of each of the plurality of drawers. The air duct may have a thermal mass. The thermal mass may be a gel pack. The method may further comprise detecting a temperature in the plurality of drawers.

The method may further comprise storing one or more parameters of the heating and/or cooling a storage system in a memory. The method of may further comprise inputting one or more predetermined parameters. The operating the plurality of drawers may comprise independently operating each of the plurality of drawers in a mode selected from the group consisting of refrigerator mode, freezer mode, thaw cabinet mode, and blast chiller mode. The method may further comprise sounding an alarm to indicate a predetermined condition.

The above-described and other features and advantages of the present disclosure will be appreciated and understood by those skilled in the art from the following detailed description and drawings.

DETAILED DESCRIPTION OF THE INVENTION

Figure 1:
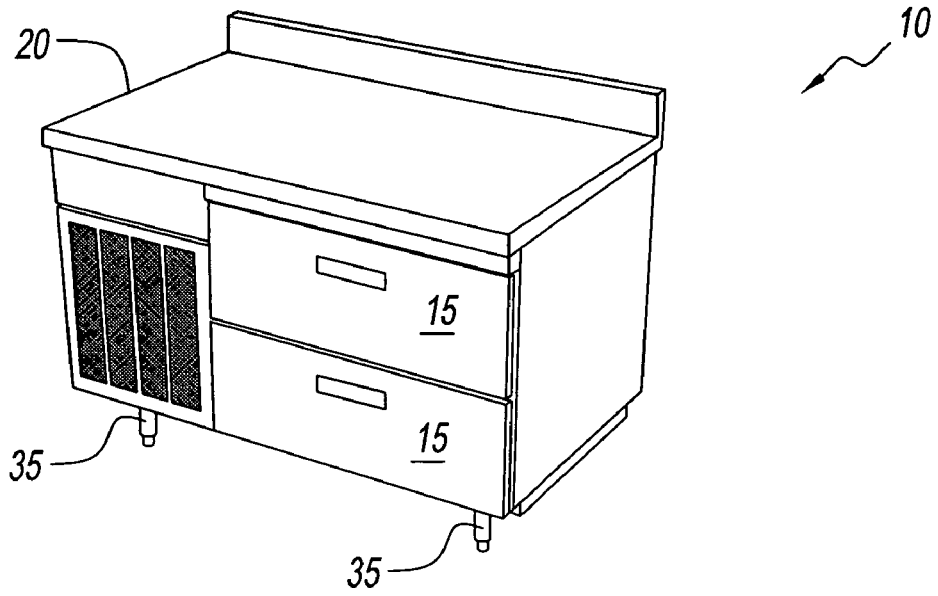
FIG. 1 is a front perspective view of a refrigeration system of the present invention.

Referring now to FIGS. 1 through 5, an exemplary embodiment of a refrigeration system generally referred to by reference numeral 10 is illustrated. Refrigeration system 10 has a storage temperature that may be varied throughout the day, week, or any time period based on items being stored therein and multi-faceted operation to provide one or more storage spaces that may be operated independently of one another. The refrigeration system 10 provides heat transfer to contents therein on all sides by providing even air-flow around all sides of containment bins or drawers.

Refrigeration system 10 has storage space and supports 35. Supports 35 may be casters, adjustable legs, any analogous support, or any combination thereof. Refrigeration system 10 may have any storage space configuration. Refrigeration system 10 may have one or more drawers 15, such as, for example, a two drawer configuration or a four drawer configuration. One or more drawers 15 may be in a side by side configuration to accommodate a low profile application or in a stacked configuration as shown in FIG. 1. The stacked configuration may also provide a work counter 20 above a topmost drawer of one or more drawers 15. Each drawer 15 may be a full extension drawer. Each drawer 15 may have a storage capacity to hold two 6 inch deep hotel pans, and an interior compartment of each drawer 15 may be about 28 inches wide by about 26 inches deep by about 10.5 inches high. Refrigeration system 10 may have any size, such as, for example, a height of about 34 inches to about 36 inches.

The particular type, including materials, dimensions and shape, of refrigerator system 10 and one or more drawers 15 that are utilized can vary according to particular storage needs. Refrigerator system 10 may be any material, for example, stainless steel, stainless steel having Acrylonitrile Butadiene Styrene (ABS) vacuum formed or high density polyethylene, or a combination thereof refrigerator liners. A thermal mass 80 may be designed into a top air duct 75. One or more drawers 15 may be any material, such as, are stainless steel. One or more drawers may be stainless steel having Acrylonitrile Butadiene Styrene (ABS) vacuum formed refrigerator liners, internal trays, and the like. Thermal mass 80 is a medium, for example, a gel pack, that provides mass to allow refrigeration system 10 to operate at a more consistent temperature, reduce number of refrigeration cycles, lower energy consumption as if partially loaded with product.

Refrigeration system 10 has a heating and cooling system 55 that includes condenser 60 and compressor 40. Compressor 40 may cycle on suction pressure. The suction pressure may be determined by settings for each of one or more drawers 15. Compressor 40 may have a 120VAC/60 cycle or 240VAC/50 cycle compressor. The two drawer configuration may have a single condensing coil with one ⅓ horsepower compressor. The four drawer configuration may have two condensing coils in series with two ⅓ horsepower compressors operating in parallel.

The two compressors in the four drawer configuration may have a first compressor operating as a duty compressor and a second compressor operating as a standby compressor. Pump down on the first compressor, preferably, is always −20 degrees Fahrenheit. The first compressor may be activated when there is a preselected first on pressure in drawer 15 and the second compressor may be activated when there is a preselected second on pressure in drawer 15. The first compressor may be deactivated on pump down at −20 degrees Fahrenheit and the second compressor may be deactivated when there is a preselected second off pressure in drawer 15. The preselected first on pressure is, such as, for example, about 72 pounds per square inch and about 5 degrees Fahrenheit below a lowest set point temperature. The preselected first off pressure is, such as, for example, about 16 pounds per square inch. The preselected second on pressure, for example, is about 78 pounds per square inch and about 2 degrees Fahrenheit below a lowest set point temperature based on pressure. The preselected second off pressure, for example, is about 66 pounds per square inch and about 10 degrees Fahrenheit below the lowest set point temperature based on pressure. The two compressors may both operate during loads greater than a preselected heavy compressor operating load, for example, about 78 pounds per square inch.

The two compressors may alternate as the duty compressor and the standby compressor. Preferably, the two compressors alternate after a predetermined compressor operating time. Thus, wear is more equally distributed among the two compressors. The cycling, preferably, only occurs when both compressors are off. A standard accumulative on time, preferably, is about 10 minutes. When one of the two compressors fails, the other compressor may become the duty compressor.

The particular type, including materials, dimensions and shape, of the condenser that is utilized can vary according to particular needs of refrigeration system 10. An example condenser is rectangular in shape and of tube and fin construction, constructed of copper or steel tubes with aluminum or steel corrugated fins which, maximizes heat exchange.

Refrigeration system 10, preferably, has one condenser fan 65 in the two drawer configuration and two condenser fans 65 in the four drawer configuration. Condenser fan 65, preferably, is a 120VAC/60 HZ or 240V/50 HZ condenser fan. One or more condenser fans 65 may operate based on a condenser temperature or a condenser outlet temperature. The one or more condenser fans and one or more compressor fans may operate either together, one at a time, or off based on demand. The four drawer configuration, preferably, has a primary condenser fan and a secondary condenser fan. The primary and secondary condenser fans maintain a constant head pressure based on a condenser temperature and operates at a maximum efficiency. The primary condenser fan may be activated at a first condenser fan on temperature, for example, of about 91 degrees Fahrenheit, and deactivated at a first condenser fan off temperature, for example, of about 81 degrees Fahrenheit. A second condenser fan may be activated at a second condenser fan on temperature, for example, of about 100 degrees Fahrenheit, and deactivated at a second condenser fan off temperature, for example, of about 91 degrees Fahrenheit. Similar to the first and second compressors, the primary and secondary condenser fans, preferably, cycle between the first and second compressors to even wear.

Figure 2:
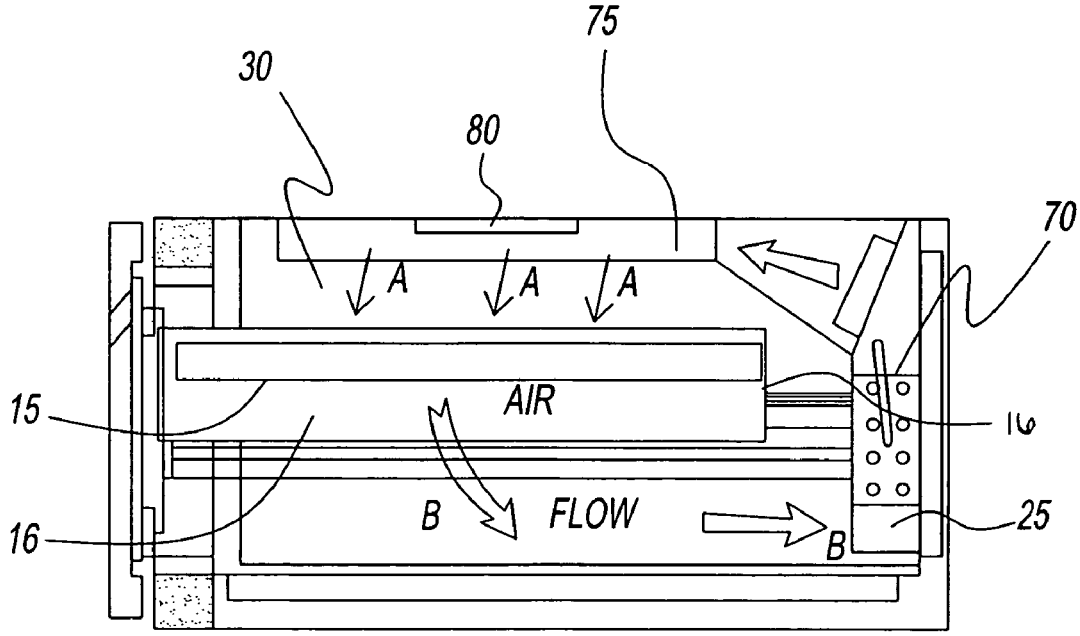
FIG. 2 schematically depicts a cross-sectional side view of a drawer of the refrigeration system.
Figure 3:
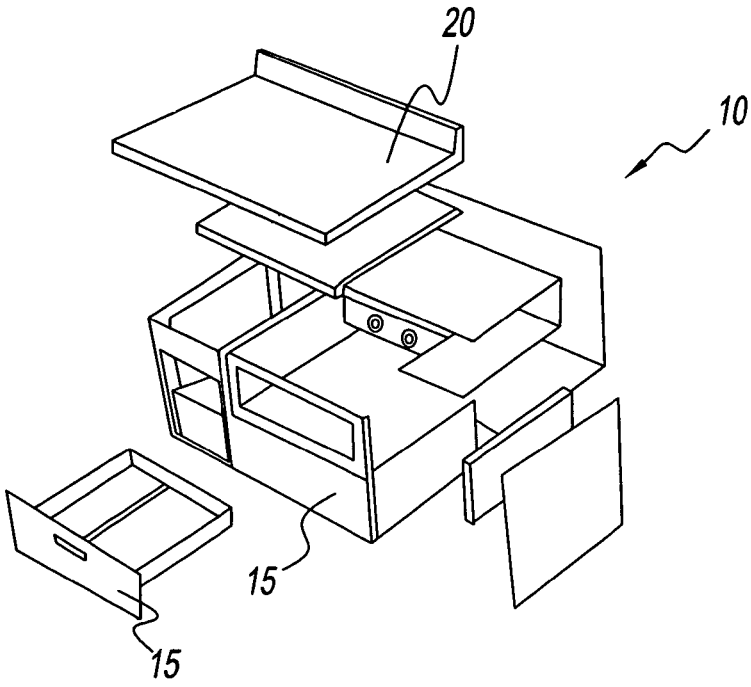
FIG. 3 is an exploded view of the refrigeration system.
Figure 4:
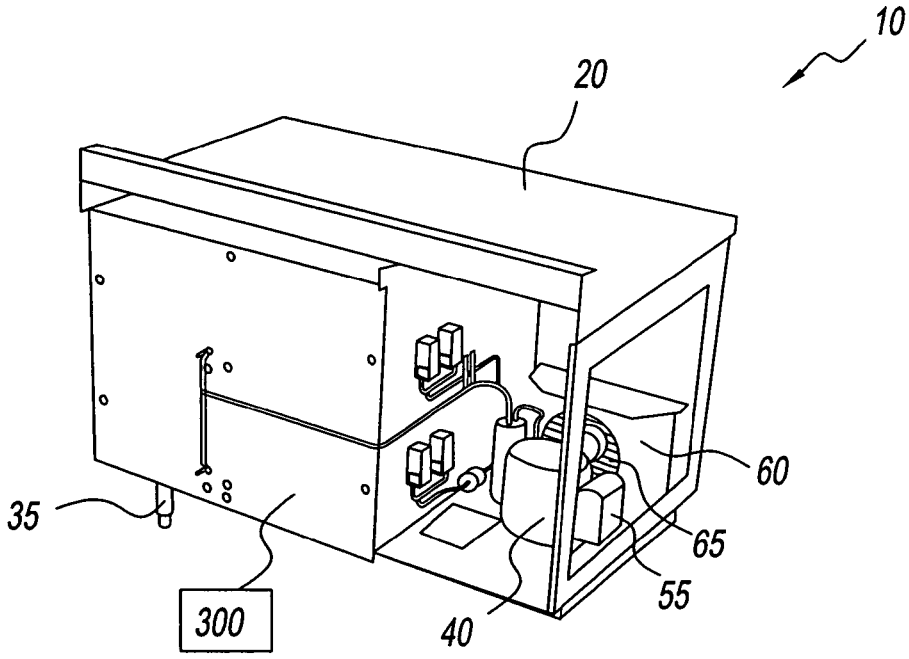
FIG. 4 is a rear cross-sectional view of the refrigeration system.

Each drawer 15 may have an evaporator assembly 70, as shown in FIG. 2. Evaporator assembly 70 is located at a rear compartment 25 of one or more drawers 15. Evaporator assembly 70, preferably, has air duct 75 to distribute cooled air evenly over a top opening 30 of each of one or more drawers 15, as shown by arrows A. Air duct 75 distributes air evenly on all sides 16 of each of one or more drawers 15 by heating and cooling system 55 generating even air-flow around all sides 16 for heat transfer therewith, as shown by arrows B. The cooled air may be distributed by one or more evaporator fans, and more preferably, two three inch twelve volt DC fans.

Each drawer 15 may have one or more output devices. Preferably, the output devices are one or more drawer cooling fans, a hot gas solenoid, and/or a refrigerant solenoid. The drawer cooling fans operate during any or all of the operating modes. When drawer 15 is opened allowing access to the contents, the one or more cooling fans, preferably, are deactivated. The drawer cooling fans, preferably, are 12 Voltage Direct Current (VDC), 2.6 w cooling fans. The hot gas solenoid, preferably, is a 120VAC/0.1 A or 240VAC/0.1 A hot gas solenoid. The refrigerant solenoid controls a flow of refrigerant during the modes of operation. The refrigeration solenoid, preferably, is controlled by the refrigeration drawer temperature set point and defrost cycle time. The refrigeration solenoid, preferably, is a 120VAC/0.1 A or 240VAC/0.1 A refrigeration solenoid.

Refrigeration system 10 has one or more input devices, and more preferably, a plurality of sensors. The sensors may include a condenser temperature sensor, a condenser outlet temperature sensor, a suction temperature sensor, and a suction pressure sensor. One or more drawers 15 may have one or more input devices, and more preferably, a plurality of sensors, such as, for example, at least one of a box temperature sensor to detect a drawer temperature in an interior of drawer 15, a defrost temperature sensor to detect a predetermined defrost temperature, and a drawer closed sensor to detect if drawer 15 is closed.

The one or more sensors of refrigeration system 10 and one or more drawers 15 may be in communication with a programmable machine and/or software, and is more preferably in communication with a computer program product having a computer useable medium with a computer readable code means embodied in the medium designed to implement the specified parameters. For example, a control processing unit (hereinafter CPU) is in communication with the one or more sensors. The particular devices and/or sensors described above can be chosen by one of ordinary skill in the art to facilitate gathering of data.

Refrigeration system 10, preferably, the CPU, has a memory. The memory stores all parameters of refrigeration system 10, such as, for example, a predetermined defrost duration, the predetermined defrost temperature, predetermined defrost cycle time, condenser temperature, condenser outlet temperature, constant head pressure, maximum efficiency, preselected heavy compressor operating load, predetermined compressor operating time, refrigeration drawer temperature set point, freezer drawer temperature set point, thaw cabinet set point, lower blast chiller drawer set point, blast chiller time period, and/or preselected default set points. Preferably, the memory stores any or all of the parameters at parameter intervals for a memory duration, more preferably, the memory stores any or all of the parameters for 30 days at 5 to 10 minute intervals, as listed in Table A.

TABLE A

| Parameter Description | Parameter | Default | Units | Range | Comments |
|---|---|---|---|---|---|
| Refrigeration Box Temperature | RBT | 37° F. | ° F. | 32 to 41° F. | |
| Freezer Box Temperature | FBT | −5° F. | ° F. | −5 to 5° F. | |
| Thaw Box Temperature | TBT | 37° F. | ° F. | 32 to 50° F. | |
| Thaw Box Hysteresis | TBH | 638 F. | ° F. | 63 to 658 F. | |
| Defrost Coil Temperature | DCT | 55° F. | ° F. | 40 to 70° F. | |
| Defrost Duration Time | DDT | 15 M | Minutes | 0 to 30 M | |
| Intervals between Defrosts | IBD | 360 M | Minutes | 180 to 480 M | |
| Suction Pressure | SP | NA | PSI | NA | |
| Condenser Temperature | CT | NA | ° F. | NA | |
| Compressor Outlet Temperature | COT | NA | ° F. | NA | |
| Primary Condenser on Temperature | PFO | 91° F. | ° F. | | |
| Primary Condenser off Temperature | PFF | 81° F. | ° F. | | |
| Secondary Condenser on Temperature | SFO | 100° F. | ° F. | | |
| Secondary Condenser off Temperature | SFF | 91° F. | ° F. | | |
| Primary Compressor on Pressure | PCN | NA | PSI | | |
| Primary Compressor off Pressure | PCF | NA | PSI | | |
| Secondary Compressor on Pressure | SCN | NA | PSI | | |
| Secondary Compressor off Pressure | SCF | NA | PSI | | |
| Blast Chill Temperature | BCT | 23° F. | ° F. | | |
| Blast Chill Time Limit | BCL | 90 M | Minutes | | |
| Units | UNT | STD | | STD or Metric | |
| Recording time intervals | RTI | 5 M | Minutes | 5 to 10 M | |
| Drawer Timeout Alarm | DTA | 5 M | Minutes | 1 to 15 M | |

Refrigeration system 10 may operate with an operating power between 85 and 264 VAC with an output of 12 VDC. A power supply 300 may connect to refrigeration system 10 to supply the operating power. Power supply 300 may have a battery backup to maintain control operation.

Figure 5:
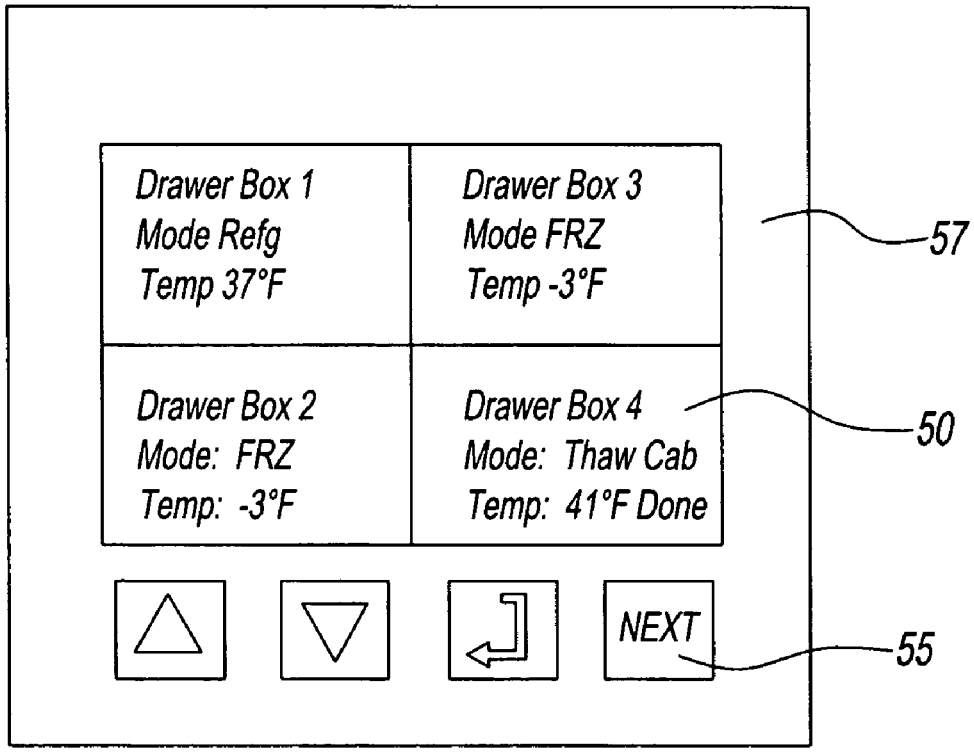
FIG. 5 is a display of the refrigeration system.

Refrigeration system 10 has a communication device. Preferably, the communication device includes a National Association of Food Equipment Manufacturer (NAFEM) Data protocol. The NAFEM Data Protocol may govern data exchange between refrigeration system 10 and computer based servers. Refrigeration system 10 has a display 50, as illustrated in FIG. 5, and preferably, a liquid crystal display. The liquid crystal display may be backlit with resolution to display characters down to 5/32 inch in height. Display 50 may have a four-button membrane switch 55 for user input. Display 50 may have an adhesive boarder 57 around membrane switches 55 and display 50.

In use, each of one or more drawers 15 of refrigeration system 10 has at least one of a plurality of operation modes selected from a refrigerator mode, freezer mode, thaw cabinet mode, and blast chiller mode, and any combinations thereof. One or more drawers 15 may operate in any one of the operation modes at any time independently of another drawer 15.

The refrigerator and freezer modes operate similar to conventional commercial units. The refrigerator mode operates as a refrigerator in drawer 15 at a refrigeration drawer temperature set point. Preferably, the refrigeration drawer temperature set point is in a range from about 32 degrees Fahrenheit to about 41 degrees Fahrenheit and has a default refrigeration drawer temperature set point of about 37 degrees. Freezer mode operates as a freezer in drawer 15 at a freezer drawer temperature set point. Preferably, the freezer drawer temperature set point is in a range from about −5 degrees Fahrenheit to about 5 degrees Fahrenheit and has a default freezer drawer temperature set point of about −5 degrees. Refrigeration and freezer modes may further include one or more defrost cycles that run successively in drawer 15. The one or more drawer cooling fans, preferably, are activated while drawer 15 is closed and deactivated when drawer 15 is open while in both the refrigerator and freezer modes. Preferably, during the refrigeration and freezer modes, the refrigeration drawer temperature set point is determined by the drawer temperature. Preferably, during the freezer mode, the freezer drawer temperature set point is determined by the drawer temperature.

The thaw cabinet mode maintains drawer 15 at a thaw cabinet set point using hot gas and refrigeration as required. For example, if the drawer temperature is 3 degrees Fahrenheit below 37 degrees Fahrenheit, the hot gas solenoid will open in drawer 15 until drawer 15 reaches 37 degrees Fahrenheit. If the box temperature rises 3 degrees Fahrenheit above 37 degrees Fahrenheit, the refrigeration solenoid will open for drawer 15 until the drawer temperature reaches 37 degrees Fahrenheit. Upon completion of the thaw cabinet mode, drawer 15 may operate in refrigerator mode, and more preferably, if drawer 15 does not require hot gas from the hot gas solenoid for a time, for example, 15 minutes, then refrigeration system 10 changes the operation mode to refrigeration mode, sounds an alarm, and displays a message on display 50. The thaw cabinet temperature set point, preferably, is in a range from about 32 degrees Fahrenheit to about 50 degrees Fahrenheit and has a default thaw cabinet temperature set point of about 37 degrees. Thaw box may have a thaw box hysteresis with a range of about 63 degrees Fahrenheit to about 65 degrees Fahrenheit and a default thaw box hysteresis of about 63 degrees Fahrenheit. Preferably, the one or more drawer cooling fans are activated at all times during the thaw cabinet mode. Thus, the thaw mode allows the user to place food in a frozen state in any of one or more drawers 15 and thaw the food at a safe temperature at a maintained drawer temperature by running refrigeration system 10 in the refrigerator mode and running the hot gas from the compressor through an evaporator coil (similar to a hot gas defrost) if the drawer temperature falls too far. Therefore, the food is thawed at a fastest rate without subjecting the food to temperatures that could allow growth of harmful bacteria.

The blast chiller mode reduces the drawer temperature to a lower blast chiller drawer set point. The lower blast chiller drawer set point is lower than the drawer temperature in the refrigerator mode to reduce a content temperature of contents stored in drawer 15 within a blast chiller time period, such as, for example, of 4 hours. The lower blast chiller drawer set point, preferably, has a default lower blast chiller drawer set point of about 23 degrees Fahrenheit. The blast chiller time period, preferably, has a default lower blast chiller time period of about 90 minutes, and more preferably, drawer 15 will remain at about 23 degrees Fahrenheit for about 90 minutes and then begin the defrost cycle. At the end of the defrost cycle, refrigeration system 10 may change to the refrigerator mode. Preferably, the one or more drawer cooling fans are activated at all times during the blast chiller mode. Thus, the blast chiller mode controls a decrease in temperature to reduce a temperature in food stored in one or more drawers 15 to a safe temperature.

The hot gas solenoid controls defrost cycles of the refrigeration and freezer modes and/or the thaw cabinet mode. A defrost cycle uses hot gas for a predetermined defrost duration, for example, 15 minutes, and/or until a hot gas solenoid coil reaches the predetermined defrost temperature, such as, for example, 55 degrees Fahrenheit. After the defrost cycle, drawer 15 returns to the operation mode the drawer 15 was in prior to the defrost cycle. Upon the expiration of a predetermined defrost cycle time another defrost cycle may be activated. The predetermined defrost cycle time is, for example, 6 hours, may lapse between one defrost cycle and a subsequent defrost cycle. The predetermined defrost cycle time, predetermined defrost duration, and/or the predetermined frost temperature may be adjustable, preferably, from the third access level. The hot gas solenoid may have a hot gas solenoid temperature ranging between about 40 degrees Fahrenheit to about 70 degrees Fahrenheit and a default hot gas solenoid temperature of about 55 degrees Fahrenheit. The predetermined defrost duration, preferably, ranges between about 0 minutes to about 30 minutes and has a default predetermined defrost duration of about 15 minutes. The predetermined defrost cycle time, preferably, ranges between about 180 minutes to about 480 minutes and has a default predetermined defrost cycle time of about 360 minutes. Preferably, the one or more drawer cooling fans are deactivated at all times during the defrost cycle.

Refrigeration system 10 may have different user access levels. Each level of access may be obtained by a different pattern of keystrokes. A first level of access allows the user to change the mode of operation, for example, between the refrigerator mode, freezer mode, and thaw cabinet mode. A second level of access allows the user to change the mode of operation, such as, for example, between the refrigerator mode, freezer mode, and thaw cabinet mode and adjust temperature parameters within the modes of operation. A third level of access allows the user to adjust parameters that affect operation of refrigeration system 10, for example, set points for the one or more defrost cycles and/or adjusting on/off points for the condenser fan. The refrigeration system 10 may return to preselected default set points in the third level access.

Refrigeration system 10 may have faults and alarms. Faults and alarms may be controlled by the CPU. Preferably, the following conditions when met will sound an alarm and show a message on display 50 to inform the user of an action or measure that should be taken: end of thaw cycle, end of the blast chill cycle, loss of power to alarm, drawer open for more than a set time, for example, 30 seconds, the drawer temperature is 10 degrees Fahrenheit above or below a temperature for more than a set time, such as, for example, 10 minutes, a blocked condenser coil, failed thermocouple, failed pressure sensor, loss of compressor, and/or loss of condenser. The fault and/or alarm will remain displayed on display 50 until rectified to inform the user that service is required for the blocked condenser coil, failed thermocouple, failed pressure sensor, loss of compressor, and/or loss of condenser. The blocked condenser alarm, preferably, is determined by a difference between a condenser temperature and a compressor outlet temperature that is less than a predetermined value. All faults and alarms, preferably, are noted in the memory. The alarm may be shut down with the touch of any button or will shutdown after a set alarm/fault period.

Advantageously, refrigeration system 10 does not require lids for each of one or more drawers 15. Refrigeration system 10 provides heat transfer to one or more drawers 15 on all sides including top opening 30 to provide even air-flow around all sides of containment bins. Refrigeration system 10 includes the capability to be a thaw cabinet. Refrigeration system 10 does not require a seal that when temperatures of the appliance interior are below freezing may cause the seal to freeze and render the drawer inoperable because of the large shear plane forces being placed on the gasket seal. Refrigeration system 10 is compatible with standard, readily available foodservice containers.

While the instant disclosure has been described with reference to one or more exemplary embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this invention.

What is claimed is:

1. A storage system that has variable temperature, the system comprising:

a plurality of drawers, wherein each drawer is capable of operating in any mode selected from the group consisting of refrigerator mode, freezer mode, thaw cabinet mode, and blast chiller mode, at any time when the storage system is in use, independently of one another; and a heating and cooling system in thermal communication with said plurality of drawers, said heating and cooling system generating even air-flow around all sides of said plurality of drawers for heating and/or cooling thereof, wherein each of said plurality of drawers is disposed within an associated housing assembly when in a closed position, such that each of said plurality of drawers is exposed to the interior atmosphere of said associated housing assembly, wherein each said associated housing assembly for each of said plurality of drawers is separate and apart from other associated housing assemblies for others of said plurality of drawers disposed within said storage system, and wherein each of said associated housing assemblies further comprises an evaporator compartment separate and apart from evaporator compartments of all other associated housing assemblies in said storage system.

2. The system of claim 1, wherein said heating and cooling system has at least one evaporator located at a rear compartment of said plurality of drawers.

3. The system of claim 2, wherein said at least one evaporator has an air duct to distribute cooled air evenly over a top opening of each of said plurality of drawers.

4. The system of claim 3, wherein said air duct has a thermal mass.

5. The system of claim 4, wherein said thermal mass is a gel pack.

6. The system of claim 1, wherein said heating and cooling system has at least one condenser, at least one compressor, and at least one evaporator.

7. The system of claim 1, further comprising at least one condenser fan.

8. The system of claim 1, further comprising a display for user input.

9. The system of claim 1, wherein said plurality of drawers are free of lids.

10. The storage system of claim 1, wherein each of said associated housing assemblies further comprises an air duct disposed therein, wherein said air flow passes through said air duct and about all said sides of said drawer disposed within said associated housing assembly.

11. A method for heating and/or cooling a storage system comprising a plurality of drawers and a plurality of housing assemblies, the method comprising:

generating even air-flow around all sides of said plurality of drawers by a heating and cooling system for heating and/or cooling thereof; and operating each of said plurality of drawers in any mode selected from the group consisting of refrigerator mode, freezer mode, thaw cabinet mode, and blast chiller mode, at any time when the storage system is in use, independently of one another, wherein each of said plurality of drawers is disposed within an associated housing assembly when in a closed position, such that said drawer is exposed to the interior atmosphere of said associated housing assembly, wherein each of said associated housing assemblies for each of said plurality of drawers is separate and apart from other associated housing assemblies for others of said plurality of drawers disposed within said storage system, and wherein each of said associated housing assemblies further comprises an evaporator compartment separate and apart from evaporator compartments of all other associated housing assemblies in said storage system.

12. The method of claim 11, wherein said heating and cooling system has at least one evaporator located at a rear compartment of said plurality of drawers.

13. The method of claim 12, wherein said at least one evaporator has an air duct to distribute cooled air evenly over a top opening of each of said plurality of drawers.

14. The method of claim 13, wherein said air duct has a thermal mass.

15. The method of claim 14, wherein said thermal mass is a gel pack.

16. The method of claim 11, further comprising detecting a temperature in said plurality of drawers.

17. The method of claim 11, further comprising storing one or more parameters of the heating and/or cooling a storage system in a memory.

18. The method of claim 11, further comprising inputting one or more predetermined parameters.

19. The method of claim 11, further comprising sounding an alarm to indicate a predetermined condition.

20. The method of claim 11, wherein each of said associated housing assemblies further comprises an air duct disposed therein, wherein said air flow passes through said air duct and about all said sides of said drawer disposed within said associated housing assembly.

* * * * *